US006360074B1

(12) United States Patent
Isogai

(10) Patent No.: US 6,360,074 B1
(45) Date of Patent: Mar. 19, 2002

(54) FIXING ROLLER AND FIXING DEVICE USING SAME

(75) Inventor: Mitsuru Isogai, Aichi-Ken (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/633,991

(22) Filed: Aug. 14, 2000

(30) Foreign Application Priority Data

Aug. 30, 1999 (JP) ..... 11-244007

(51) Int. Cl.[7] ..... G03G 15/20
(52) U.S. Cl. ..... 399/333; 430/124
(58) Field of Search ..... 399/333, 109, 399/328, 330, 331, 339; 430/98, 99, 124

(56) References Cited

U.S. PATENT DOCUMENTS 4,812,873 A * 3/1989 Inagaki et al. ..... 399/331
5,035,927 A * 7/1991 Chen et al. ..... 430/99 X
5,217,837 A * 6/1993 Henry et al. ..... 430/124
5,608,508 A * 3/1997 Kumagai et al. ..... 399/339
5,960,245 A * 9/1999 Chen et al. ..... 399/333
5,966,578 A 10/1999 Soutome et al.

FOREIGN PATENT DOCUMENTS

EP 0694584 * 1/1996

* cited by examiner

*Primary Examiner*—Sandra Brase
(74) *Attorney, Agent, or Firm*—McDermott, Will & Emery

(57) ABSTRACT

A fixing device has a fixing roller which heat-fixes an unfixed toner image on a recording member transported between the fixing roller and another rotating member. The fixing roller is provided with a base member, a surface coat layer provided on the surface of the base member and which comes into contact with the recording member during the fixing process, and a silica protective layer provided over the part of the surface not provided with the surface coat layer.

14 Claims, 3 Drawing Sheets

FIXING ROLLER AND FIXING DEVICE USING SAME

This application is based on Patent Application No. 11-244007 filed in Japan, the content of which is hereby incorporated by reference.

BACKGROUND OF THE INVENTION

1. Field of the Invention

The present invention relates to a fixing roller and a fixing device using same for fixing an image of unfixed toner on a recording member.

2. Description of the Related Art

With the increasing awareness of environmental issues in recent years, studies were begun on the re-use of components and parts used in copiers and printers. Methods of re-use include methods for reducing parts to basic levels and reforming and finishing as has been generally done conventionally for paper and aluminum cans, and methods wherein only the depleted parts are reproduced.

The fixing roller for applying heat to fix an unfixed toner image on a recording member used in printers and copiers uses aluminum, iron or the as a base member over which is formed a surface coat layer formed of Teflon resin, silicon rubber or the like.

The service life of such a fixing roller is determined by the deterioration, wear, and damage to the material of the surface coat layer formed on the exterior surface of the base member, since there is little change of the base member part over time. However, problems arise when the base member part is directly re-used. Specifically, the boss of the fixing roller is subject to wear and damage through contact and rubbing against other parts, so as to require reproduction. This reproduction work requires time, labor, and cost.

Bushings made of heat-resistant resin are inserted between the boss at both ends of the base member and the bearings which received them so as to prevent heat damage caused by thermal transfer. Discrepancy of the dimension, position, and inclination of the boss and the heat-resistant resin bushing is the cause of abrasion of the boss and bushing. In general, it is extremely difficult to eliminate this discrepancy, and the bushing becomes worn. When the bushing becomes worn, one may consider replacing the bushing with a new bushing, however, heat-resistant resin is expensive. In addition, disposing of the heat-resistant resin bushing leads to the problem of environmental pollution.

On the other hand, it has been proposed to make the boss of the base member of heat-resistant resin and screw attach this boss to the end of the metal base member. Such an arrangement would allow the base member to be re-used by simply replacing the boss, and would not incur time and labor. It has been further proposed that the boss of the base member be formed of stainless steel having a high wear resistance. Such an arrangement would reduce the wear and damage to the boss and extend its service life.

Since the boss of the base member is formed of heat-resistant resin, however, the replacement of a boss formed of expensive heat-resistant resin as described above is influenced by cost even though it is advantageous to re-use the base member. Furthermore, disposing of the heat-resistant resin waste material leads to the disadvantage of environmental pollution. Even forming the boss of the base member using stainless steel does not prevent wear of the boss, and even slight wear of the boss requires reproduction of the base member, an operation also incurring cost. Mixing aluminum, iron, and stainless steel forms an alloy which is ultimately re-usable by melting, a process which is troublesome.

OBJECTS AND SUMMARY

In view of the aforesaid information, the present invention relates to an improved fixing roller and fixing device using same.

The present invention provides an easily re-usable fixing roller and fixing device using this fixing roller, and this re-use does not require labor or cost.

These and other objects are attained by one aspect of the present invention which is a fixing roller which heat-fixes an unfixed toner image on a recording member transported between the fixing roller and another rotating member, wherein the fixing roller is provided with a base member, a surface coat layer provided on the surface of the base member and which comes into contact with the recording member during the fixing process, and a silica protective layer provided over the part of the surface not provided with the surface coat layer.

According to this construction, the fixing roller heat-fixes the toner image via the applied heat as the recording member bearing the unfixed toner image is transported between the fixing roller and the other rotating member. At this time, an excellent fixing result is attained by satisfying surface conditions wherein the surface coating of the fixing roller comes into contact with the recording member and the toner carried thereon, and a nip width necessary for the separation of the recording member and for heat fixing is formed by elastic deformation.

During the fixing process, the surface coat layer provided on the base member of the fixing roller deteriorates, becomes worn and damaged over time, until it eventually reaches the end of its serviceable life. However, the surface of the part of the base member not provided with the surface coat layer is provided with a silica protective layer which is extremely thin but protects by means of its high hardness, wear resistance and corrosion resistance. That is, wear and damage associated with changes in service life caused by contact with the bearing and other parts providing support for the rotational drive are prevented at the part of the base member not provided with the surface coat layer. In this way the service life of the base member is extended, and the base member can be directly re-used without labor or cost of a recycling operation by simply peeling off the surface coat layer when the end of its service life has been reached. A further advantage is that a mixture of different metals is not required in the base member.

When the silica protective layer is obtained by calcination of perhydropolysilazane, the layer may be formed by a low temperature operation, and can prevent deterioration of the surface and deformation of the base member even when the base member is made of conventional material such as aluminum or iron.

Even if the silica protective layer is provided on the surface of the bearing-supported part and other contact parts and oscillating parts formed of heat-resistant resin of the base member, a similar protection can be obtained when the heat-resistant resin is part of the base member.

According to another aspect of the present invention, the fixing roller heat-fixes an unfixed toner image on a recording member transported between the fixing roller and another rotating member, wherein the fixing roller is provided with a base member, a surface coat layer provided on the surface of the base member and which comes into contact with the recording member during the fixing process, and a silica protective layer provided over the part of the surface provided with the surface coat layer which oscillates with a thermo switch and the like.

According to this construction, the part of the surface coat layer which oscillates with a thermo switch or the like which detects temperature of the surface coat layer during use of the fixing roller is protected by the high hardness and wear resistance of the silica protective layer. In this way reduction of the service lifer of the surface coat layer through oscillation of other parts is prevented. In this case, when the silica protective layer is provided on the base member, it may be formed by calcination of perhydropolysilazane at low temperature to thermally protect the surface coat layer.

BRIEF DESCRIPTION OF THE DRAWINGS

These and other objects and features of the present invention will become apparent from the following description of the preferred embodiments thereof taken in conjunction with the accompanying drawings, in which.

In the following description, like parts are designated by like reference numbers throughout the several drawings.

DETAILED DESCRIPTION OF THE PREFERRED EMBODIMENTS

In the following embodiments, a fixing roller and fixing device fix an image of powder resin toner on a recording member such as plain paper, OHP sheet and or the like. The powder toner develops an electrostatic latent image on the surface of a photosensitive member so as to render it visible. This toner image is directly or indirectly electrostatically transferred onto a recording member, and fixed to the recording member by the fixing device. The fixing device has a pair of fixing rollers that mutually press one against another. The surfaces of the pair of fixing rollers are provided with a surface coat layer, and at least one of the rollers has a heating source. A recording member bearing a transferred toner image is fed into the area (nip) in which the two fixing rollers press together so as to be inserted between the two fixing rollers and pass between the two fixing rollers via the rotation of the two fixing rollers. During this time, the heating source heats the fixing roller so as to melt the toner image on the recording member and fix the toner image thereon. Since the surface of the fixing roller is covered by a surface coat layer having release characteristics, the melted toner is not offset onto the fixing roller.

The fixing roller and fixing device described below is used in image forming apparatuses such as copiers, printers, facsimiles, microfilm reader printers and the like. A fluid or liquid toner image may be used, and color images formed by overlaying toner images of a plurality of colors, or monochrome images formed by toner of a single color may be used.

The fixing roller and fixing device are described hereinafter with reference to the accompanying drawings.

Figure 1:
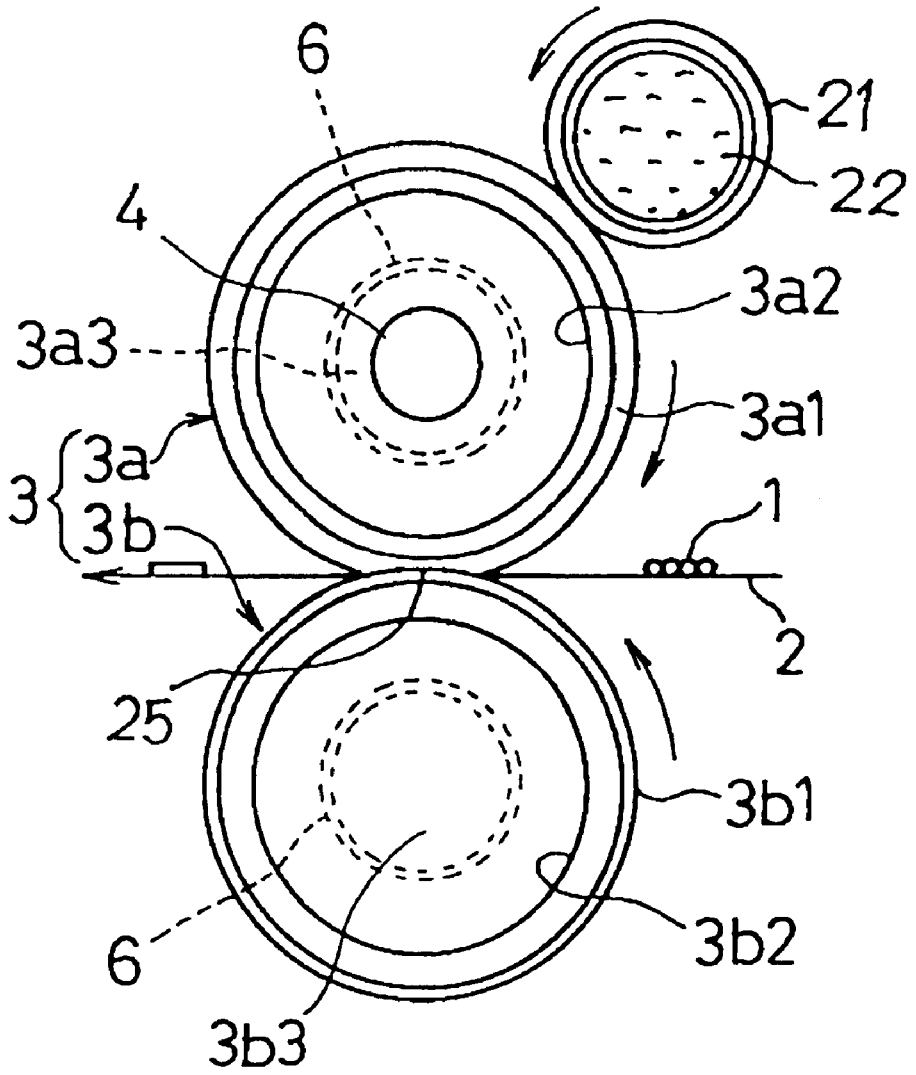
FIG. 1 is a section view briefly showing the construction of a fixing device of a first embodiment.
Figure 2:
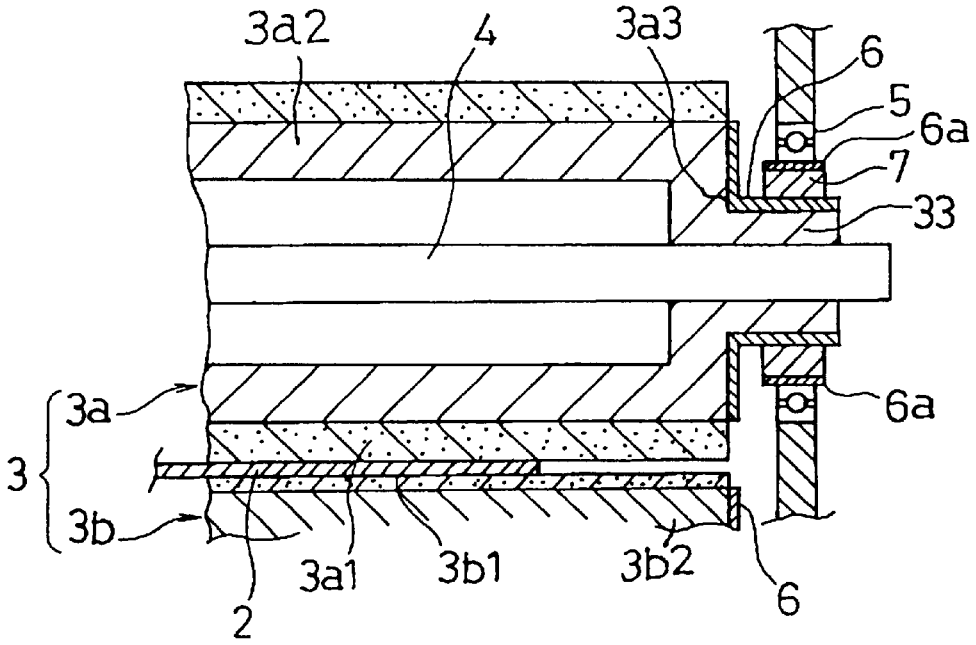
FIG. 2 is a section view in the length direction briefly showing the construction of a fixing device of a first embodiment.

Referring to FIGS. 1 and 2, A pair of fixing rollers 3*a* and 3*b* have base members 3*a*2 and 3*b*2 formed of aluminum and having a hollow cylindrical shape with a boss 33 at bilateral ends, and a surface coat layer 3*a*1 and 3*b*1 covering the surface of the base member 3*a*2 and 3*b*2 excluding the boss 33. The boss 33 is supported by a bearing 5 provided on a frame through a bushing 7, such that the fixing rollers 3*a* and 3*b* are supported by the frame so as to be rotatable. The surface coat layer 3*a*1 of the fixing roller 3*a* is formed of an elastic silicon rubber, and the fixing roller 3*b* is formed of a fluororesin.

A recording member 2 supporting an unfixed toner image 1 is gripped between the surface coat layers 3*a*1 and 3*b*1 and is transported via the rotation of the fixing rollers 3*a* and 3*b*. Inside the fixing roller 3*a*1 positioned on the top side is provided a heating source 4 such as a halogen heater or the like to heat the fixing roller 3*a*. In this way the toner image on the recording member gripped and transported between the fixing rollers 3*a* and 3*b* is melted and fixed onto the recording member 2. A silica protective layer 6 is provided on the surface of the boss 33 of the base members 3*a*2 and 3*b*2 which is not provided with a surface coat layer, and the surface of the bilateral ends 3*a*3 and 3*b*3 connecting the boss 33 and the surface of the base members 3*a* and 3*b*.

The Silica protective layer 6 protects the base members 3*a*2 and 3*b*2 from corrosion, electrochemical corrosion between the different metals, and damage through contact with foreign material. For this reason the silica protective layer 6 is desirably provided on all surfaces not provided with the surface coat layer 3*a*1 and 3*b*1, as shown in FIG. 2.

However, the silica protective layer 6 also may be provided only on parts having a high probability of suffering wear and damage through contact and oscillation with other parts due to the rotation of the fixing rollers 3*a* and 3*b*. That is, the silica protective layer 6 may be provided only on the surface of the boss 33 which contacts the bushing 7, and the silica protective layer 6 may be omitted on the endfaces 3*a*3 and 3*b*3.

The fixing rollers 3*a* and 3*b* transport the recording member 2 gripped therebetween, as described previously. During this transport, the toner image 1 is heat-fixed by the heat applied from the heating source 4. In order to achieve excellent heat fixing, the surface coat layer 3*a*1 of the fixing roller 3*a* in contact with both the recording member 2 and the toner image 1 must be elastically deformed by the mutual pressure contact. That is, both fixing rollers 3*a* and 3*b* come into contact along a predetermined width via the elastic deformation of the surface coat layer 3*a*1, and the recording member 2 transported through this contact area (nip) is heated. The surface coat layer 3*a*1 and 3*b*1 must possess specific release characteristics so that recording member 2 discharged from the nip area does not wrap around the fixing rollers 3*a* and 3*b*, or the melted toner 1 does not adhere to the surface of the fixing roller 3*a* via the heat fixing.

The surface coat layers 3*a*1 and 3*b*1 deteriorate, become worn and damaged over time due to the repeated fixing processes, such that the elasticity and releases characteristics required to achieve excellent fixing are no longer satisfied and the end of the service life is reached. On the other hand, the surface of endfaces 3*a*3, 3*b*3 and the boss 33 not provided with the surface coat layers 3*a*1 and 3*b*1 and the base members 3*a* and 3*b* are protected from wear and corrosion by a silica protective layer 6. The silica protective layer 6, although extremely thin, is sufficiently effective having very high hardness, abrasion resistance, and corrosion resistance. Accordingly, changes related to the service life of the base member 3a2 and 3b2 caused by wear and damage are prevented regardless of the contact and oscillation of the boss 33 with the bushing 7 which supports the boss 33 to allow rotational drive.

For this reason, when the surface coat layers 3a1 and 3b1 reach the end of their service life, the surface coat layers can be peeled from the base members 3a and 3b, and new surface coat layers provided to allow re-use of the base members 3a2 and 3b2. Conventional base members are not provided with the silica protective layer, and are constructed to allow replacement of the boss which is subjected to abrasion and damage, and although the base members can be reproduced by replacing the worn boss with a new boss, this operation requires time and labor for reproduction to be possible.

Alternatively, when a surface coat layer is provided, the boss need not be constructed of stainless steel or other metal resistant to abrasion. That is, the entire base member may be constructed of a single metal such as aluminum or the like. In this way when the base member is ultimately melted for re-use, the disadvantages associated with re-use of mixed metals is avoided.

In the embodiment shown in FIGS. 1 and 2, the silica protective layer 6 is obtained by calcination of perhydropolysilazane (PHPS). This calcination is attained by, for example, the changes represented in the chemical formulae below, such that the silica protective layer 6 can be formed by a low temperature operation.

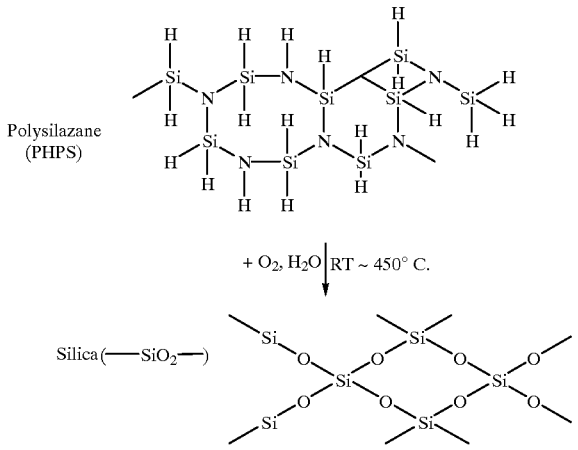

The higher the calcination temperature, the harder and stronger the silica protective layer 6 becomes. However, the silica protective layer 6 can be calcinated even at a low temperature of about 80° C. When the calcination temperature is less than about 300° C., the surface of base members 3a2 and 3b2 do not deteriorate, not do the base members 3a2 and 3b2 deform even when the base members 3a2 and 3b2 are made of materials such as aluminum and iron. In this case, when the silica protective layer 6 is formed to a thickness of 0.1~1 μm, the hard silica protective layer 6 possesses a certain degree of flexibility, but is not susceptible to damage by nicking or fracture due to its hardness, such that the silica protective layer 6 lengthens the service life of the base members 3a2 and 3b2.

The bushing 7 is formed of heat-resistant resin, and prevents the heat from the fixing roller 3a from escaping around the bearing. A silica protective layer 6 is provided on the surface of the bushing 7, as shown in FIG. 2. In this way the bushing 7 may also be re-used with the base members 3a2 and 3b2. Heat-resistant resin parts are generally expensive, such that a re-usable bushing 7 is advantageous from a cost perspective.

Figure 3:
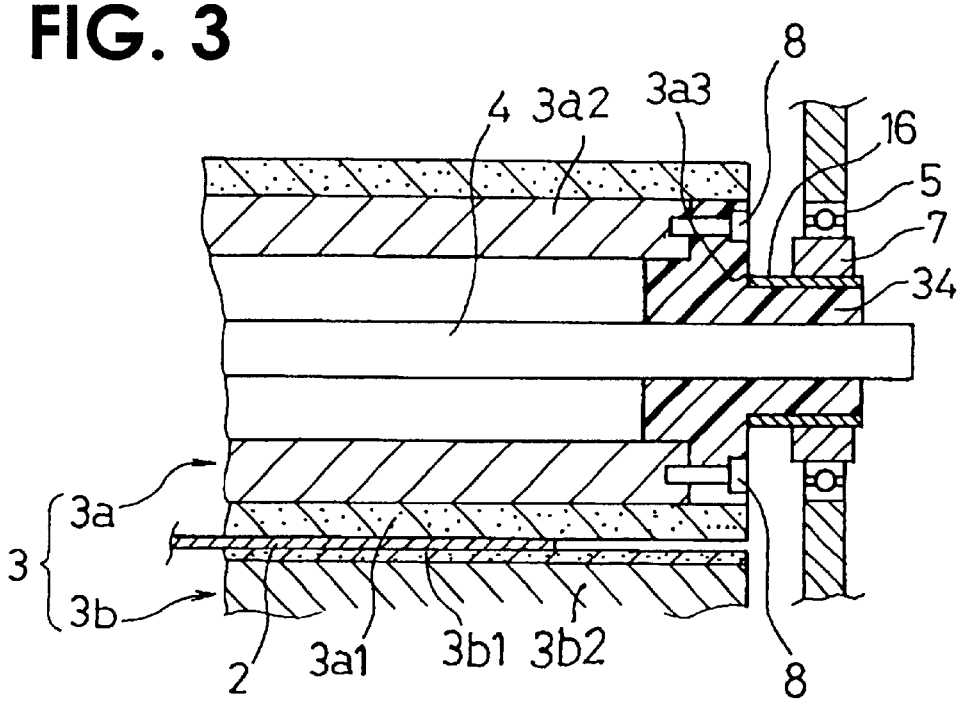
FIG. 3 is a section view in the length direction briefly showing the construction of a fixing device of a second embodiment.

A second embodiment is shown in FIG. 3. The second embodiment differs from the embodiment shown in FIGS. 1 and 2 in that the boss 34 is constructed as a separate member from the base member 3a2. The boss 34 is formed of a heat-resistant resin, and is fixedly attached at the bilateral ends of the base member 3a2 by bolts 8 fitted at bilateral ends of the base member 3a2. The surface of the boss 34 formed of heat-resistant resin is provided with a silica protective layer 16, so as to prevent wear and abrasion through oscillation and contact with other parts supporting the boss 34. In this way the service life of the heat-resistant resin part is extended, restricting consumable parts, and the boss 34 can be directly re-used as a unit with the base members 3a2 and 3b2. When both ends 3a3 formed of a heat-resistant resin have a shorter service life than the base member 3a2, the bolts 8 may be removed to remove the ends 3a2 which are then replaced. Since the boss 34 is protected by the silica protective layer 16, the number of replacements is greatly reduced compared to unprotected bosses.

Figure 4:
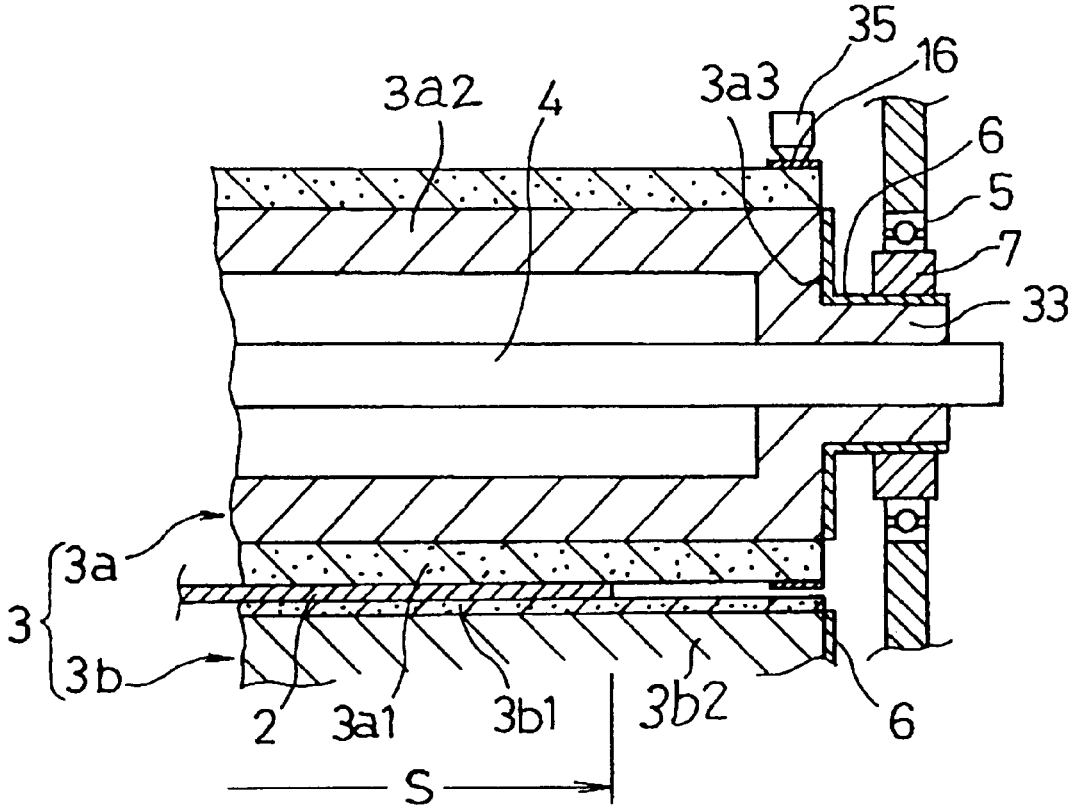
FIG. 4 is a section view in the length direction briefly showing the construction of a fixing device of a third embodiment.

A third embodiment is shown in FIG. 4. The third embodiment provides the addition of a thermo switch 35 to the embodiment of FIG. 2. The thermo switch 35 switches the heating source 4 On and OFF in accordance with the temperature of the fixing roller 3a. In this way the operation of the heating source 4 is controlled, and the temperature of the fixing roller 3a is controlled. The thermo switch 35 is disposed opposite the surface coat layer 3a1 of the fixing roller 3a at a position outside the paper feeding range S through which passes the recording member 2. A silica protective layer 16 is provided on the surface of the surface coat layer 3a1 opposite the thermo switch 35, and rubs the thermo switch 35 in conjunction with the rotation of the fixing roller 3a. Furthermore, an identical silica protective layer is provided on the part of the thermo switch 35 which contacts the silica protective layer 16.

According to this construction, the silica protective layer 16 protects the surface coat layer 3a1 from rubbing the thermo switch 35 in conjunction with the rotation of the fixing roller 3a, and prevents abrasion of part of the surface coat layer 3a1 at the bilateral ends of the fixing roller 3a. In this way the fixing roller 3a is usable within the limits of the service life of the surface coat layer 3a1 corresponding to the sheet feeding range S. Although a silica protective layer is provided on the surface coat layer 3a1 rubbed by the thermo switch 35 in the present embodiment, this provision is not limited to the thermo switch 35, inasmuch as a silica protective layer may protect parts of the surface coat layer rubbed by other components. In this way the silica protective layer protects the surface coat layer 3a1 by its high hardness and wear resistance, thereby preventing a reduction in the service life of the entire fixing roller 3a caused by excessive wear on part of the surface coat layer.

The silica protective layer 16 is desirably formed of perhydropolysilazane calcinated at low temperature to provide thermal protection for the base member 3a2 and surface coat layer 3a1. A silica protective layer obtained by calcination below 150° C. is particularly suitable for providing thermal protection for the surface coat layer 3a1. A thin silica protective layer 16 having a thickness of 0.07~0.5 μm is suitable to avoid cracking caused by the elastic deformation of the surface coat layer 3a1.

The fixing device shown in FIGS. 1 and 2 is provided with an oil application roller 21 for applying oil to prevent adhesion of the toner image on the pair of fixing rollers 3*a* and 3*b*. This oil application roller 21 holds oil 22 in its interior, and exudes the oil to the outer surface when in contact with the fixing roller 3*a*. This oil 22 is uniformly applied to the surface of the fixing roller 3*a* via the rotation of the fixing roller 3*a*, so as to prevent the melted toner from adhering to the fixing roller 3*a*.

Although the surface coat layer of the top fixing roller is formed of silicon rubber so that only the top fixing roller is elastically deformable in the above embodiments, the surface coat layers of both fixing rollers also may be formed of an elastic material such that both rollers are elastically deformable through mutual contact.

In the above embodiments, only the top fixing roller is provided with a heating source, but heating sources also may be provided for both fixing rollers.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. A fixing roller which heat-fixes an unfixed toner image on a recording member transported between the fixing roller and another rotating member, said fixing roller comprising:

a base member;

a surface coat layer, which is provided on a surface of the base member, for coming into contact with the recording member during a fixing process; and a silica protective layer provided over a part of the surface not provided with the surface coat layer.

2. A fixing roller as claimed in claim 1, wherein said silica protective layer is obtained by calcination of perhydropolysilazane.

3. A fixing roller as claimed in claim 1, further comprising a bearing-supported part provided at bilateral ends of the fixing roller, the part being coated with the silica protective layer.

4. A fixing roller which heat-fixes an unfixed toner image on a recording member transported between the fixing roller and another rotating member, said fixing roller comprising:

a base member;

a surface coat layer, which is provided on a surface of said base member, for coming into contact with the recording member during a fixing process, and a silica protective layer provided over a part of the surface coat layer which oscillates with an object.

5. A fixing roller as claimed in claim 4, wherein said object includes a thermo switch.

6. A fixing roller as claimed in claim 4, wherein said silica protective layer is obtained by calcination of perhydropolysilazane.

7. A fixing roller as claimed in claim 4, further comprising a bearing-supported part provided at bilateral ends of the fixing roller, the part being coated with the silica protective layer.

8. A fixing device which heat-fixes an unfixed toner image on a recording member, said fixing device comprising:

a fixing roller; and a rotating member, which is in contact with said fixing roller, for transporting the recording member in cooperation with said fixing roller;

wherein said fixing roller includes;

a base member, a surface coat layer, which is provided on a surface of the base member, for coming into contact with the recording member during a fixing process, and a silica protective layer provided over a part of the surface not provided with the surface coat layer.

9. A fixing device as claimed in claim 8, wherein said silica protective layer is obtained by calcination of perhydropolysilazane.

10. A fixing roller as claimed in claim 8, wherein said fixing roller includes a bearing-supported part provided at bilateral ends of the fixing roller, the part is coated with the silica protective layer.

11. A fixing device which heat-fixes an unfixed toner image on a recording member, said fixing device comprising:

a fixing roller; and a rotating member, which is in contact with said fixing roller, for transporting the recording member in cooperation with said fixing roller;

wherein said fixing roller includes;

a base member, a surface coat layer, which is provided on a surface of the base member, for coming into contact with the recording member during a fixing process, and a silica protective layer provided over a part of the surface coat layer which oscillates with an object.

12. A fixing device as claimed in claim 11, wherein said object includes thermo switch.

13. A fixing device as claimed in claim 11, wherein said silica protective layer is obtained by calcination of perhydropolysilazane.

14. A fixing device as claimed in claim 11, wherein said fixing roller includes a bearing-supported part provided at bilateral ends of the fixing roller, the part is coated with the silica protective layer.

* * * * *